US007770825B2

(12) United States Patent
Kajuch

(10) Patent No.: US 7,770,825 B2
(45) Date of Patent: Aug. 10, 2010

(54) BODYSPRAY HAVING ADJUSTABLE SPRAY ORIENTATION

(75) Inventor: Pete Kajuch, Brookfield, WI (US)

(73) Assignee: Kohler Co., Kohler, WI (US)

( * ) Notice: Subject to any disclaimer, the term of this patent is extended or adjusted under 35 U.S.C. 154(b) by 441 days.

(21) Appl. No.: 11/805,784

(22) Filed: May 24, 2007

(65) Prior Publication Data

US 2007/0228189 A1 Oct. 4, 2007

Related U.S. Application Data

(62) Division of application No. 11/069,696, filed on Mar. 1, 2005, now Pat. No. 7,455,247.

(51) Int. Cl.
*B05B 15/08* (2006.01)

(52) U.S. Cl. ..... 239/587.1

(58) Field of Classification Search .... 239/587.1–587.5
See application file for complete search history.

(56) References Cited

U.S. PATENT DOCUMENTS

| | | | | |
|---|---|---|---|---|
| 2,776,168 | A * | 1/1957 | Schweda | 239/587.4 |
| 3,375,532 | A | 4/1968 | Gellmann | |
| 4,422,191 | A | 12/1983 | Jaworski | |
| 4,545,083 | A | 10/1985 | Searson | |
| 4,944,049 | A | 7/1990 | Leonard | |
| 5,142,714 | A | 9/1992 | Klotzbach | |
| 5,228,625 | A * | 7/1993 | Grassberger | 239/558 |
| 5,526,982 | A | 6/1996 | McKenzie | |
| 5,704,547 | A | 1/1998 | Golan et al. | |
| 6,148,453 | A | 11/2000 | Sartor | |
| 6,908,047 | B2 | 6/2005 | Saunders et al. | |
| 7,455,247 | B2 | 11/2008 | Kajuch | |
| 7,628,341 | B2 | 12/2009 | Kajuch | |
| 2009/0114739 | A1 | 5/2009 | Furseth | |

FOREIGN PATENT DOCUMENTS

| | | |
|---|---|---|
| DE | 10011504 | 9/2001 |

OTHER PUBLICATIONS

PCT Written Opinion of the International Searching Authority for International Application No. PCT/US2006/007063, Sep. 20, 2007.
Dornbracht, Dornbrach presents MEM, www.dornbracht.com/en/gen/pressdtl.htm?prt=1&cid=63%id=990.
English abstract thereof also.

* cited by examiner

*Primary Examiner*—Davis Hwu
(74) *Attorney, Agent, or Firm*—Quarles & Brady LLP

(57) ABSTRACT

A bodyspray assembly is provided that includes a coupling assembly connected to a spray face. The spray face is operable to emit a directed spray having an omni-directionally adjustable angular orientation. Hence, a spray face in the form of a tile having an array of outlets can direct spray in a variety of directions, or be parallel to a mounting wall for decorative purposes.

4 Claims, 10 Drawing Sheets

BODYSPRAY HAVING ADJUSTABLE SPRAY ORIENTATION

CROSS-REFERENCE TO RELATED APPLICATIONS

This application is a divisional of U.S. application Ser. No. 11/069,696 filed on Mar. 1, 2005 now U.S. Pat. No. 7,455,247.

STATEMENT REGARDING FEDERALLY SPONSORED RESEARCH OR DEVELOPMENT

Not applicable.

BACKGROUND

The present invention relates to bodysprays installed in showers that project water at the body of the user, and in particular, to bodyspray devices having angularly adjustable valve outlet orientations.

Modern bathing space design has evolved a category known in the art as a "custom shower." A variety of valve options are available in the custom shower, from the decorative trim style to the number of water outlets and outlet locations, along with the construction materials and architecture of the valves. The variety of options render each custom shower unique in appearance and function.

Water outlets used in these assemblies typically include combinations of one or more showerhead devices, handshower devices, and bodyspray devices, depending on the selected water control valves. Bodyspray valves can be mounted on a vertical shower wall and project water essentially horizontally at the body.

A variety of conventional bodyspray devices are commercially available that are designed to provide desirable water coverage and spray feel to the user. Several even enable a sprayhead to pivot within a predetermined range.

A need exists for a compact wall-mounted bodyspray assembly having a flat spray face that directs a spray in a direction whose angular orientation is easily manually adjustable.

SUMMARY

The present invention provides a bodyspray assembly including a coupling assembly connected to a spray face having an angular orientation that can be omni-directionally adjusted, thereby correspondingly adjusting the angular orientation of a spray directed from the spray face.

Specifically, in one form the invention provides a bodyspray assembly configured to receive supply water from a source and emit the supply water as a directed spray. A bi-directional coupling assembly includes a housing rotatable about a first axis, and a body rotatable about a second axis. The coupling assembly receives the supply water. A spray outlet assembly includes an array of nozzles extending through a spray face. The nozzles receive the supply water from the coupling assembly, and output the supply water as a directed spray. The spray outlet assembly is connected to the bi-directional coupling assembly such that the nozzles are pivotable about to both the first and second axes. An escutcheon, configured for mounting on the wall, surrounds the spray face such that the spray face is substantially flush with respect to the wall.

The supply water can flow from the housing through the body. The spray outlet assembly can receive the supply water from the body.

The first housing is a water flow housing supported by a waterway member. The water flow housing is rotatable with respect to the waterway member about the first axis. The waterway member has a pair of arms supporting the water flow housing, at least one of the arms providing an outlet that delivers the supply water to the water flow housing.

The body is an elbow waterway body supported by the water flow housing. The elbow waterway body is rotatable with respect to the water flow housing about the second axis. A second elbow waterway body can also be supported by the water flow housing. The second elbow waterway body is rotatable with respect to the water flow housing about the second axis. The water flow housing can have an inlet and a first and second radial outlet, such that the first and second elbow waterway bodies are rotatably received in first and second radial outlets, respectively.

The bodyspray assembly can have a water inlet assembly connecting the source to the bi-directional coupling assembly. A casing supports the water inlet assembly, the bi-directional coupling assembly, and the spray outlet assembly.

The spray face can be flat, in the form of a tile, receiving the nozzles.

In one aspect, the axes of rotation are coplanar. In another aspect, the axes of rotation are orthogonal. In still another aspect, the axes of rotation are independent with respect to each other to provide for omni-directional angular adjustment of the nozzles.

In another form, a bodyspray assembly extends along a central longitudinal axis and is configured to receive supply water from a source and emit the supply water as a directed spray. A coupling assembly includes a housing configured for rotation about at least a first and second axis. A spray outlet assembly has a flat spray face defining an array of apertures. The spray outlet assembly is connected to the housing such that a longitudinal depressive force applied to the spray face at a position offset from the central longitudinal axis causes the nozzles to pivot about an axis normal to an axis defined between the central longitudinal axis and the position.

In one form, the bi-directional coupling assembly further has a body that rotatably supports the first housing.

In another form, the coupling assembly can be an omni-directional coupling assembly having a hub that provides an outer spherical track, such that the housing rides along the track.

In one aspect, the supply water flows through the coupling assembly.

The advantages of the invention will be apparent from the detailed description and drawings. What follows are preferred embodiments of the present invention. To assess the full scope of the invention the claims should be looked to as the preferred embodiments are not intended as the only embodiments within the scope of the invention.

DETAILED DESCRIPTION

Figure 1:
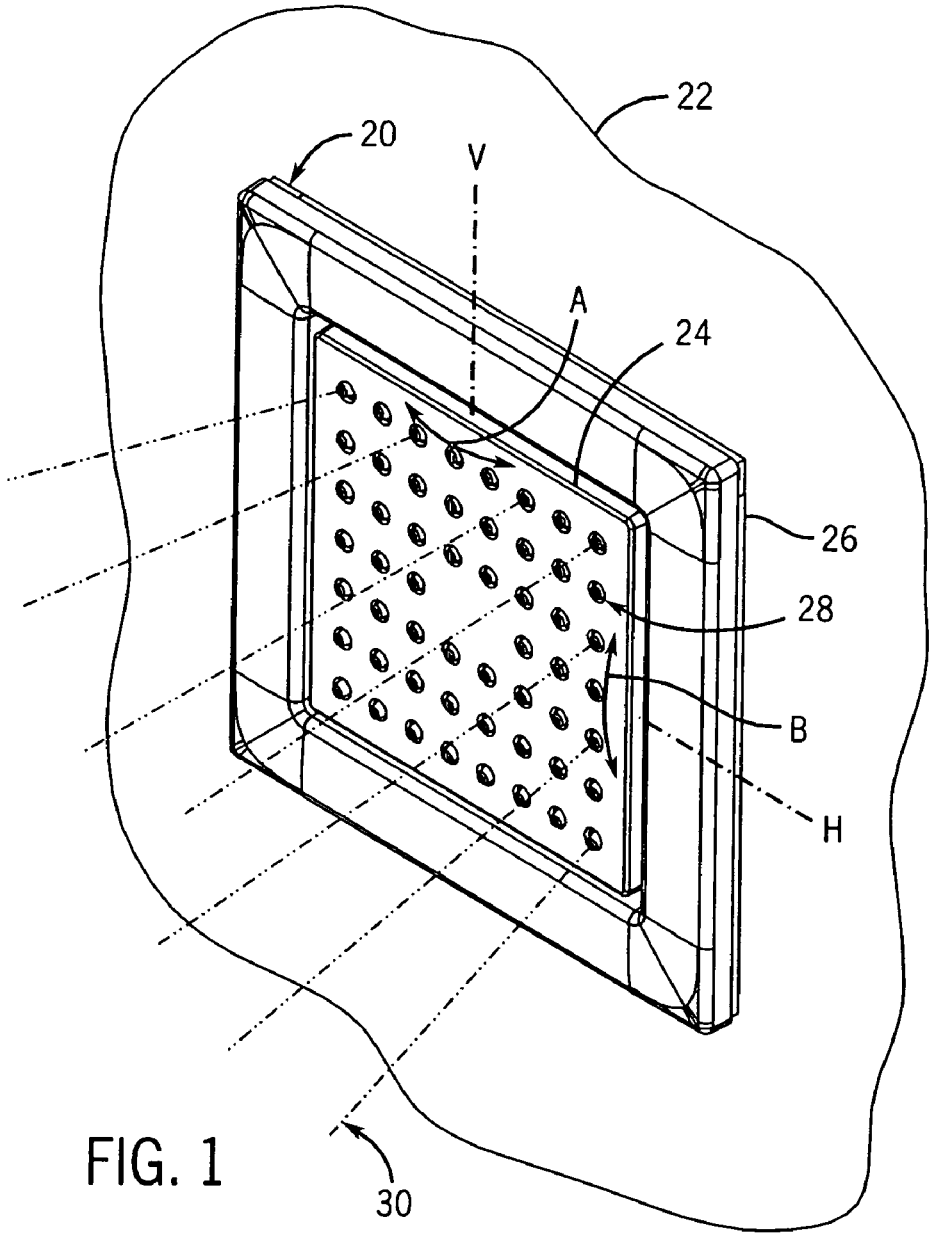
FIG. 1 is a perspective view of an adjustable spray face forming part of a bodyspray assembly constructed in accordance with the principles of the present invention.
Figure 2:
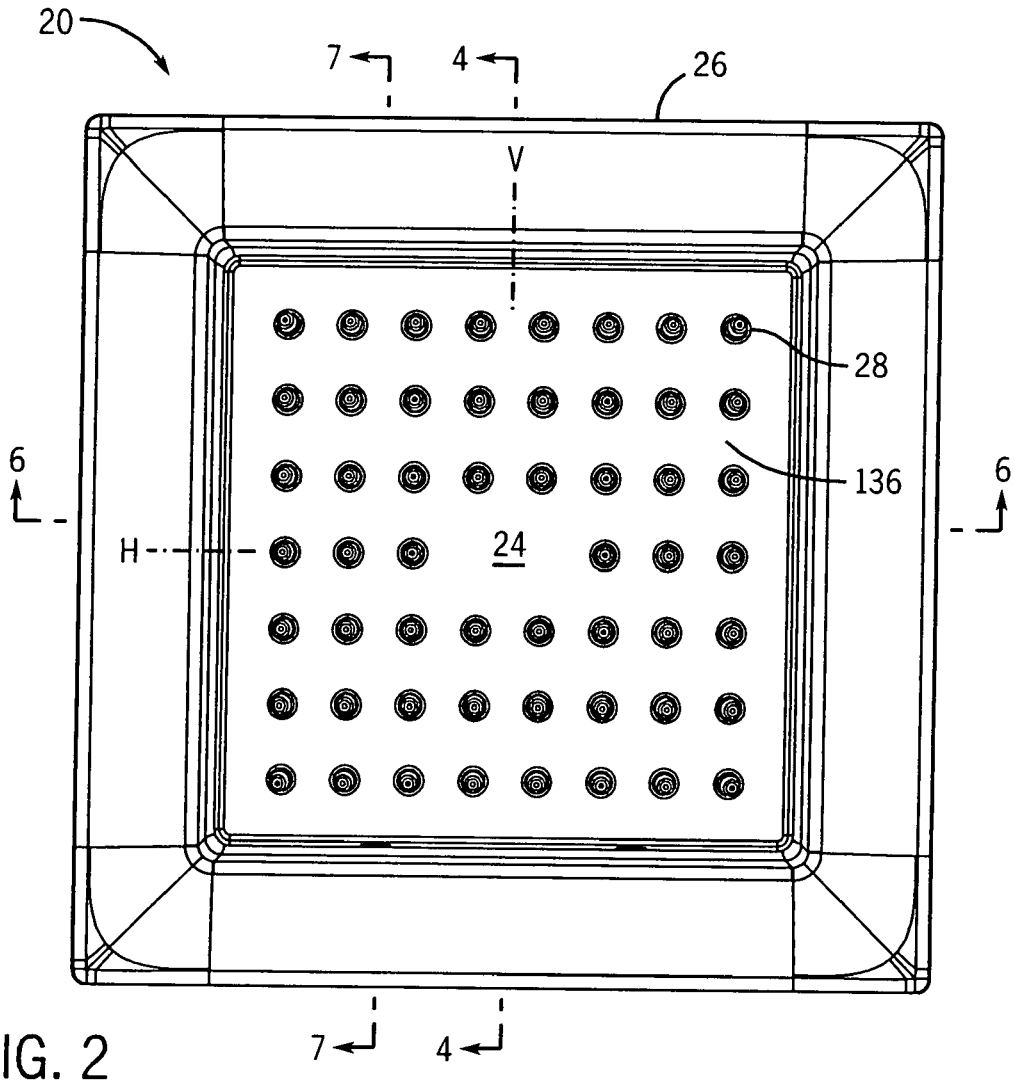
FIG. 2 is a front elevation view of the spray face illustrated in FIG. 1 showing the spray face extending along a vertical axis V and a horizontal axis H.

Referring to FIGS. 1 and 2, a bodyspray assembly 20 is mounted into a vertically extending mounting wall 22 of a shower enclosure. Wall 22 can be tiled in the usual manner, and bodyspray assembly 20 thus includes a substantially flat, and generally rectangular (e.g., square), spray face 24, in the form of a tile that blends into tiled wall 22. Spray face 24 is surrounded by a decorative escutcheon 26 that is mounted onto the surface of shower wall 22. Spray face 24 can be substantially flush, or co-planar, (or slightly recessed) with respect to escutcheon 26. Spray face 24 is thus also substantially flush, or co-planar, (or slightly recessed) with respect to shower wall 22. The term "substantially flush" is used to describe an arrangement whereby two members are within ½ inch, or more preferably ¼ with respect to each other. An array of nozzles 136 extends through a corresponding array of nozzle outlets 28 formed in spray face 24. The array of outlets 28 is decoratively arranged, and spray face 24 could alternatively include numerous other array configurations. Water flows through nozzle outlets 28 as a directed spray 30 towards a user stationed inside the shower.

Spray face 24 is manually pivotable about both a vertical axis V (in the directions indicated by double-arrow A) and a horizontal axis H (in the directions indicated by double-arrow B). Hence spray face 24 can direct spray 30 in a variety of directions, or be parallel to mounting wall 22 for decorative purposes. The axes V-V and H-H are vertical and horizontal, respectively, because bodyspray assembly 20 is mounted onto vertically extending wall 22. However, the present invention is not intended to be so limited and, for instance, bodyspray assembly 20 could alternatively be mounted onto a horizontal wall (e.g., a ceiling), in which case orthogonal axes V and H would extend horizontally. The ability of spray face to pivot about two axes provides for omni-directional adjustment of the angular orientation of directed spray 30, as will be described in more detail below.

Figure 3:
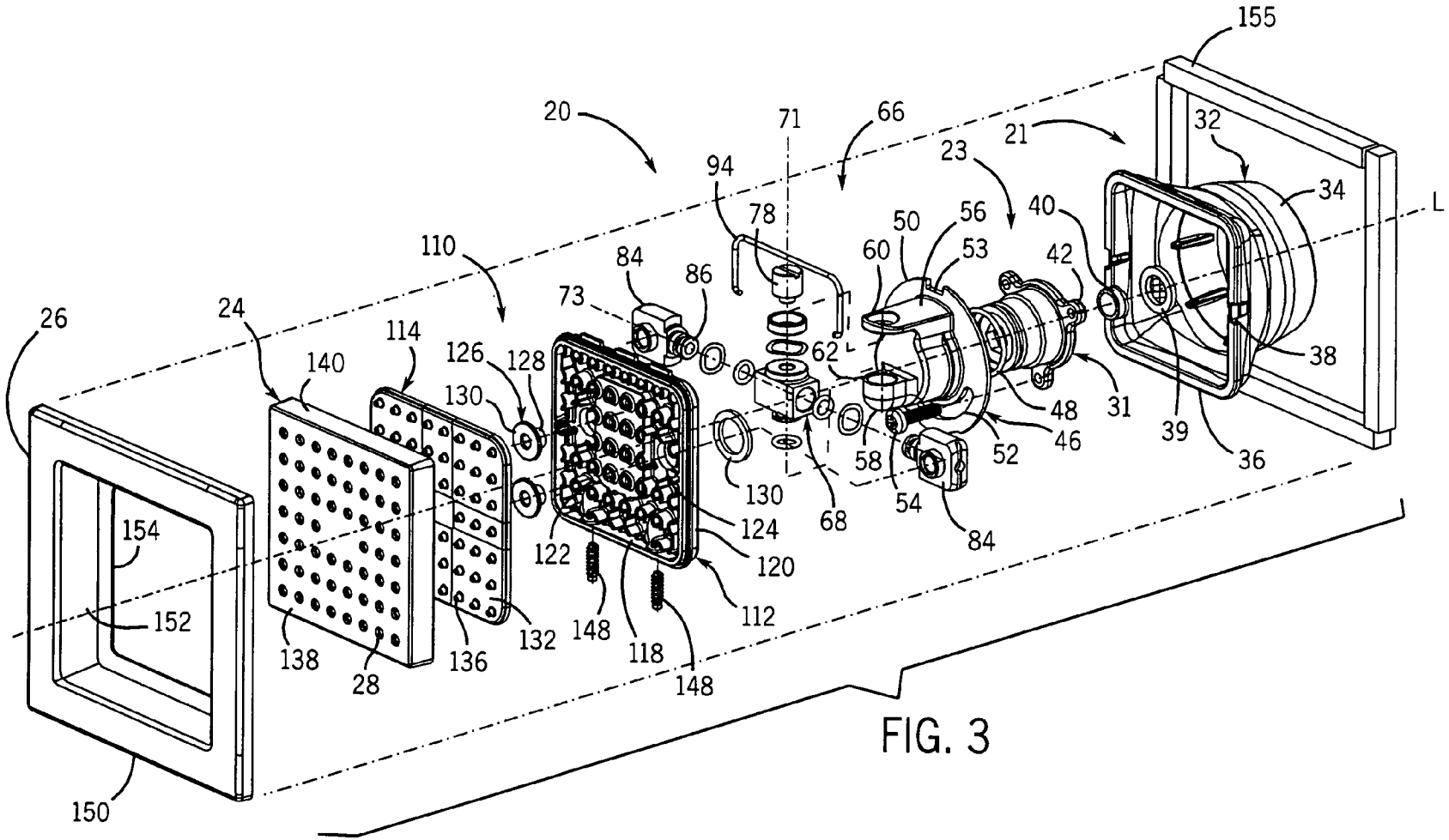
FIG. 3 is an exploded assembly view of the bodyspray assembly.
Figure 4:
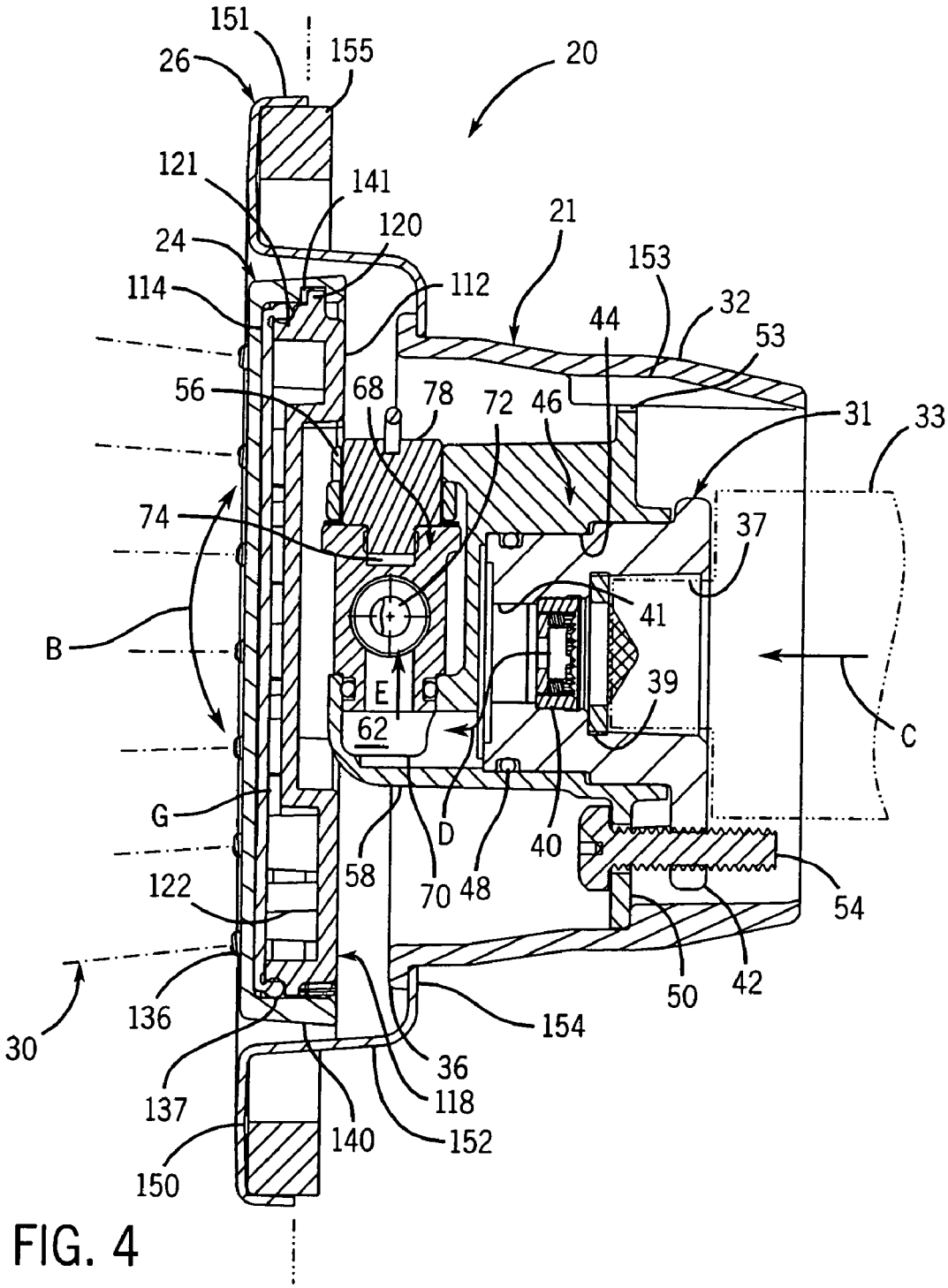
FIG. 4 is a sectional side elevation view of the body spray outlet assembly taken along line 4-4 of FIG. 2.

Referring to FIGS. 3 and 4, the bodyspray assembly 20 includes a casing 21 formed from an inner housing member 32 and escutcheon 26. The casing 21 retains a water inlet assembly 23, a bi-directional coupling assembly 66, and a spray outlet assembly 110, each assembly extending along a longitudinal axis L-L. While the various components are described below as being formed from various exemplary materials, it should be appreciated the present invention is not to be construed as limited to the described materials, and that the various components could be formed from numerous alternative materials as understood by one having ordinary skill in the art.

Inner housing 32 can be formed from any polymer (such as polyoxymethylene (POM), also known as acetal) suitable for minimizing water leakage through assembly 20. Housing 32 includes a substantially cylindrical body 34 coupled to a generally rectangular (or square) forwardly projecting flange 36 that mates with escutcheon 26, as will be described in more detail below. A pair of notches 38 is formed in opposing outer ends of flange 36.

The water inlet assembly 23 includes a National Pipe Taper (NPT) pipe fitting 31 that contains a flow regulator 40 and a filter screen 39. Pipe fitting 32 is connected to a water supply pipe 33 (FIG. 4) extending longitudinally through cylindrical body 34 and carrying pressurized supply water. Pipe fitting 31 has an inlet 37 that receives supply water pipe 33, and an outlet 39 disposed longitudinally opposite inlet 37. The supply water thus travels longitudinally forward along the direction of arrow C (FIG. 4) through filter screen 39 (which removes impurities from the supply water) and regulator 40 (which meters the water flow rate through bodyspray assembly 20). The filtered and metered water exits pipe fitting via an outlet 39. Pipe fitting 31 includes three equally radially spaced threaded mounting flanges 42 extending radially outwards with respect to longitudinal axis L-L.

The filtered and regulated water supply exits pipe fitting 31 and enters bi-directional coupling assembly 66, which includes a substantially U-Shaped waterway member 46, a substantially rectangular water flow housing 68 and a pair of elbow waterway bodies 84, each of which fabricated from any suitable material, such as brass. Bi-directional coupling assembly 66 enables omni-directional pivoting of spray face 24 while, at the same time, transporting the supply water between supply pipe 33 and nozzle outlets 28.

The waterway member 46 includes an inlet 44 that receives outlet 39 of pipe fitting 31 via a sealing o-ring 48. Waterway member 46 includes a generally circular base 50 presenting openings 52 (one shown) that receive a screws 54 (one shown). Waterway member 46 is thus connected to pipe fitting via screws 54 extending through openings 52 that are threadedly received by flanges 42. A radial notch 53 extends into base 50, and provides a key that interlocks with an inner housing surface 153 (FIG. 4) to prevent the rotation of body spray assembly 20 about longitudinal axis L-L.

A pair of opposing horizontally disposed upper and lower arms 56 and 58, respectively, extend longitudinally forward from base 50. A substantially cylindrical bearing aperture 60 extends through upper arm 56 that is vertically aligned with a substantially cylindrical supply water outlet 62 extending vertically through lower arm 58. Lower arm 58 is substantially hollow to define an internal flow path through waterway member 46, indicated by arrow D (FIG. 4), that links inlet 44 and outlet 62 in fluid communication.

Figure 5:
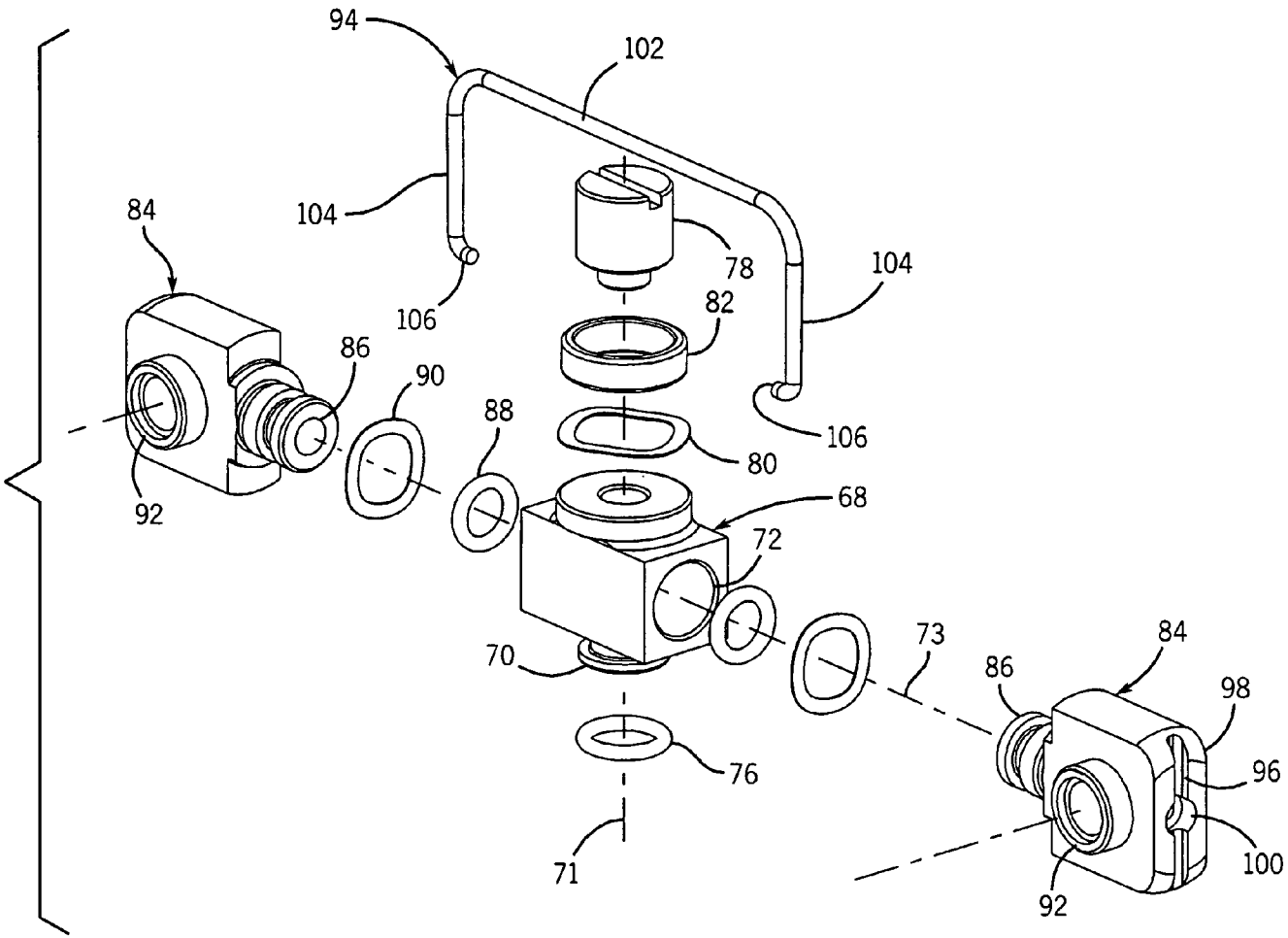
FIG. 5 is an exploded assembly view of a bi-directional coupling assembly forming part of the bodyspray assembly illustrated in FIG. 3.

Referring now also to FIG. 5, water flow housing 68 includes a substantially cylindrical inlet 70 extending through the lower wall of housing 68 along a first, radially directed, vertical axis 71. Inlet 70 is in fluid communication with a substantially cylindrical channel 72 extending horizontally through housing 68 along a second, radially directed, lateral axis 73. A substantially cylindrical aperture 74 extends downwards partially through the upper wall 69 of housing 68 along vertical axis 71, and terminates prior to passageway 72.

Housing 68 is inserted between arms 56 and 58 of waterway member 46 such that outlet 62 of waterway member 46 receives inlet 70 of water flow housing 68 via a sealing o-ring 76. A spacer 82 facilitates assembly of housing 68 into waterway member 46. Specifically, a washer 80 creates friction through spring pressure to stabilize the position of water flow housing 68. A shoulder screw 78 is attached rigidly to housing 68 to form a pivot journal coaxial with inlet 70, mating with bearing aperture 60 and securing spacer 82 which, in turn, secures the engagement between water flow housing 68 and waterway member 46. The supply water thus travels vertically from outlet 62 and into inlet 70 along the direction of arrow E (FIG. 4). Shoulder screw 78 and inlet 70 are rotatable in apertures 60 and 62 of waterway member 46, thus enabling water flow housing 68 to rotate with respect to waterway member 46 about vertical axis 71

Figure 6:
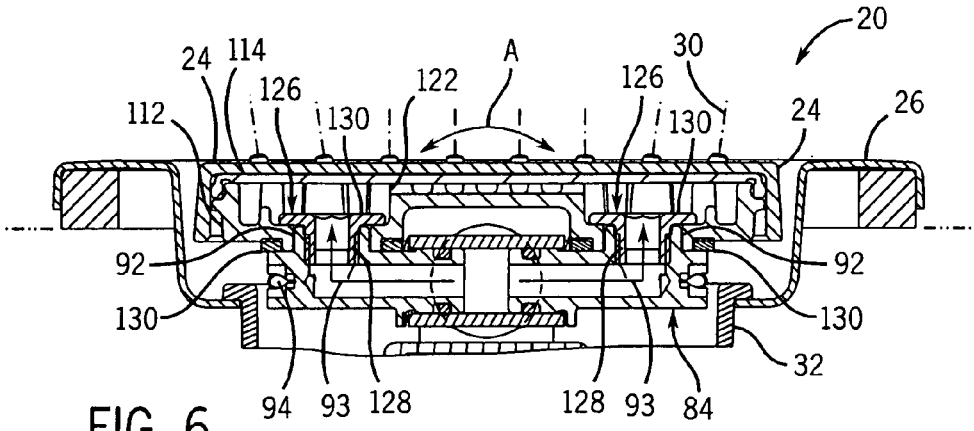
FIG. 6 is a sectional side elevation view of the bodyspray assembly taken along line 6-6 of FIG. 2.

Referring also to FIG. 6, each elbow waterway body 84 is coupled to an outer end of channel 72. Specifically, each elbow waterway body 84 includes a substantially cylindrical inlet 86 extending inwardly along lateral axis 73 that is rotatably received by channel 72 via a sealing o-ring 88 and a washer 90. Each elbow waterway body 84 further includes a substantially cylindrical outlet 92 that extends longitudinally forward. The supply water thus travels from channel 72 of water flow housing 68 into elbow inlet 86 and follows a lateral, and subsequently longitudinal, channel 93 prior to flowing through elbow outlet 92. It should be appreciated that channel 72, while extending radially, nonetheless operatively advances the supply water in a direction toward spray face 24.

Referring again to FIGS. 3-5, elbow waterway bodies 84 are retained against water flow housing 68 via a clamp 94. Specifically, each elbow waterway body 84 includes a vertical groove 96 formed in its laterally outer side wall 98. An aperture 100 extends laterally into side wall 96 approximately midway along groove 96, and terminates short of the internal channel. Clamp 94 includes a laterally extending horizontal bar 102 connected at its outer ends to vertical flexible arms 104 extending downwardly from bar 102. Each arm 104 is connected at its outer end to a horizontal connector flange 106 extends laterally inwards from arm 104. Each arm 104 fits in groove 96 such that connector flange 106 extends into aperture 100. Arms 104 have a stiff spring constant, and therefore provide a sufficient compressive force that biases elbow waterway bodies 84 against water flow housing 68.

Inlets 86 are rotatably received by channel 72, thus allowing each elbow waterway body 84 to be rotatable with respect to water flow housing 68 about lateral axis 73. It should thus be appreciated that the rotatability of water flow housing 68 about vertical axis 71 allows elbow waterway bodies 84 to be rotatable with respect to both vertical and lateral axes 71 and 73. The rotatability of elbow waterway bodies 84 correspondingly enable angular adjustments of the orientation of spray face 24.

While housing 68 and elbow waterway bodies 84 are illustrated as being co-planar (causing axes 71 and 73 to likewise be co-planar), the present invention recognizes that bi-directional coupling assembly 66 could be designed such that housing 68 and body 84 (and corresponding axes 71 and 73) are not co-planar. In addition, while axes 71 and 73 are orthogonal, the present invention is not intended to be so limited and, in fact, any two axes of rotation, wherein one axis is inclined with respect to the other to provide for angular adjustment of spray face 24, is intended to be encompassed by the present invention. Furthermore, while a pair of elbow waterway bodies 84 is provided, one skilled in the art will appreciate that the present invention could alternatively include a single elbow waterway body 84 that facilitates rotation about axes 71 and 73.

Referring again to FIGS. 3 and 4, spray outlet assembly 110 is disposed downstream of bi-directional coupling assembly 66, and includes a sprayhead 112, a nozzle membrane 114, and spray face 24.

Sprayhead 112 includes a generally rectangular (or square) body 118 having an outwardly extending peripheral flange 120 and a peripheral recess 121 disposed forward from flange 120. Body 118 is formed from any suitable polymer, such as an acetal copolymer (for example, a Celcon® acetal copolymer). A plurality of spacer members 122 extend longitudinally forward from body 118. A pair of laterally spaced, substantially cylindrical, apertures 124 extends forward from body 118 in longitudinal alignment with a corresponding elbow outlet 92.

Referring also to FIG. 6, sprayhead 112 is connected to elbow waterway bodies 84 via a pair of brass fasteners 126, each including a cylindrical body 128 and an annular head 130. The cylindrical body 128 of each fastener 126 is inserted through corresponding aperture 124 such that fastener head 130 rests against sprayhead body 118 and cylindrical body 128 is threaded into the corresponding elbow outlet 92. A rubber washer 130 seals the interface between each elbow outlet 92 and sprayhead 112.

Advantageously, the connection of sprayhead 112 to elbow waterway bodies 84 (and indirect connection of sprayhead 112 to water flow housing 68) facilitates the rotation of sprayhead 112 about both vertical axis 71 and lateral axis 73.

Referring again to FIGS. 3 and 4, nozzle membrane 114 includes a generally rectangular (or square) body 132 formed from any suitable material, such as an ethylene propylene rubber, for instance ethylene propylene diene (EPDM). Body 132 includes an array of spaced nozzles 136, and includes an inwardly extending peripheral flange 137. Flange 137 seals water during operation.

Nozzle membrane 114 is thus attached to sprayhead 112 by interlocking flange 137 in peripheral recess 121 of sprayhead body 118. Spacer members 122 create a gap G (FIG. 4) disposed between sprayhead 112 and membrane 114 that enables the supply water to travel through nozzles 136. Spacer members 122 support membrane 114 when nozzles 136 are to be cleaned.

Figure 7:
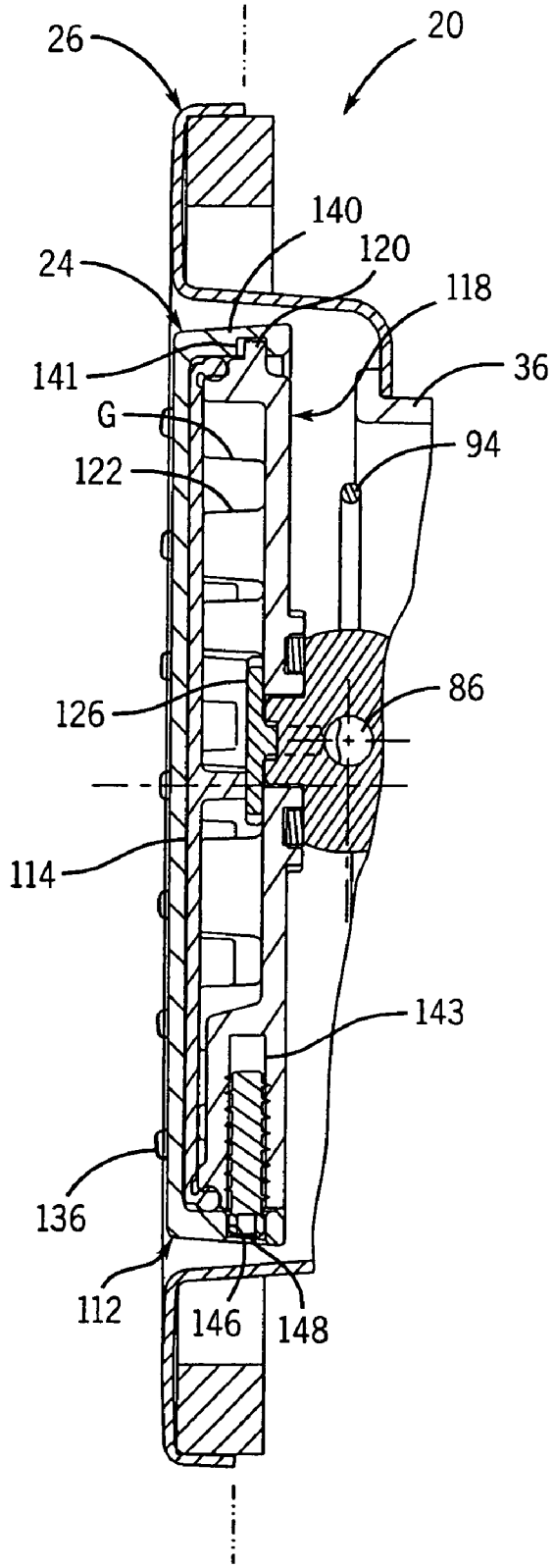
FIG. 7 is a sectional side elevation view of the bodyspray assembly taken along line 7-7 of FIG. 2.

Referring also to FIG. 7, spray face 24 includes a generally rectangular (or square) brass body 138 having an outer peripheral flange 140 extending longitudinally inward from body 138. A peripheral vertical recess 141 extends partially into flange 140, and receives flange 120 of sprayhead 112 to interlock spray face 24 and sprayhead 112. A pair of connecting apertures 146 extends up through lower longitudinal flange 140, and is aligned with a corresponding pair of vertical apertures 143 extending up through the lower surface of sprayhead body 118. A pair of screws 148 extends through apertures 146, and is threaded into apertures 143 to lock spray face 24 and spray head 112. Nozzle membrane 114 is thus sandwiched between spray face 24 and spray head 112, and is sufficiently compressed to form a seal about the peripheral flange 137.

An array of spaced nozzle outlets 28 is formed through spray face body 138 and receives nozzles 136. The supply water exiting nozzles 136 thus exits spray outlet assembly 110 as directed spray 30. Advantageously, nozzle membrane 114 is curved inwardly (such that the longitudinally outer surface of membrane 114 is concave) prior to installation such that when membrane 114 is flattened to abut flat spray face 24, nozzles 136 diverge to produce corresponding diverging spray 40. Accordingly, it should thus be appreciated that certain aspects of the present invention enable the directional control of nozzles 136 by direct cooperation between curved nozzle membrane 114 and flat spray face 24.

Referring now to FIGS. 3 and 4, casing 21 is fastened by attaching escutcheon 26 to inner housing member 32. Specifically, escutcheon 26 includes an outer frame 150 integrally connected to an outer longitudinally inwardly extending flange 151. Frame 150 is further integrally connected to a longitudinally inwardly extending flange 152. Flange 152 is integrally connected at its outer end to a pair of laterally inwardly extending lips 154. Lips 154 engage inner housing flange 36 to prevent rotation of bodyspray assembly 20. Notches 38 in flange 36 assist the user in connecting escutcheon to inner housing member 32. A frame 155, which can be made from a rubber or foam material, is positioned at the interface between frame 150 and flange 151, and seals escutcheon 26 against shower wall 22.

Figure 8:
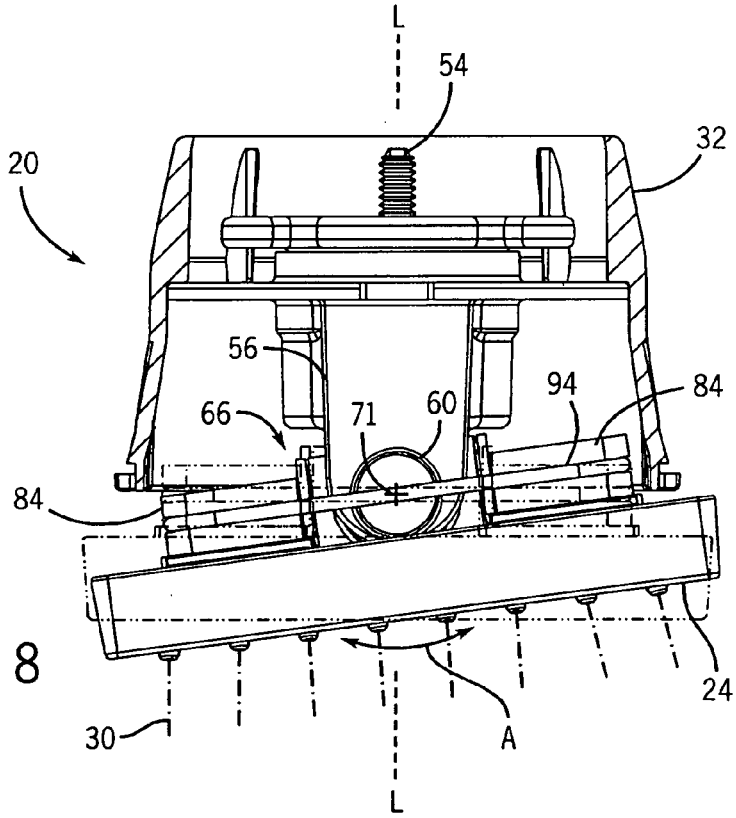
FIG. 8 is a top elevation view of the bodyspray assembly showing the spray face pivoted about a vertical axis.

Advantageously, the angular orientation of spray outlet assembly 110 (and the corresponding directed spray) is easily manually adjustable by a user. Specifically, referring to FIG. 8, the user is able to simply press against spray face 24 with his or her finger 156 on either side of vertical axis V to rotate spray outlet assembly 110 (and bi-directional coupling assembly 66) about vertical axis 71 (FIG. 3) in the direction of arrow A from a first position (illustrated in hidden lines) to a second position rotated with respect to the first position. Nozzles 136 are correspondingly pivoted, and spray 30 can thus be directed from side-to-side.

Figure 9:
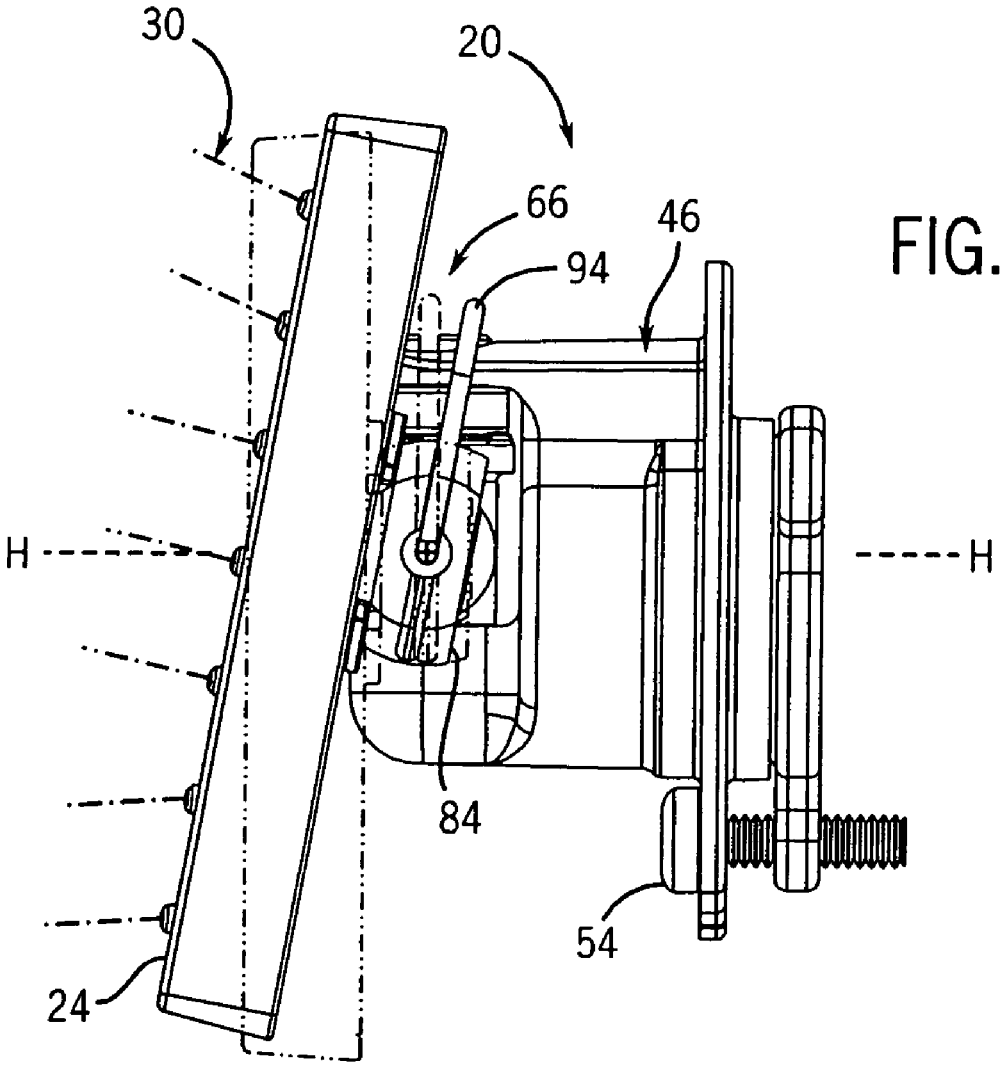
FIG. 9 is a partial side elevation view of the bodyspray assembly, but showing the spray face pivoted about a horizontal axis.

Alternatively, referring to FIG. 9, the user is able to simply press against spray face 24 with his or her finger 156 on either side of horizontal axis H to rotate spray outlet assembly 110 (and bi-directional coupling assembly 66) about horizontal axis 73 (FIG. 3) in the direction of arrow B from a first position (illustrated in hidden lines) to a second position rotated with respect to the first position. Nozzles 136 are correspondingly pivoted, and spray 30 can thus be directed up-and-down. Advantageously, bodyspray assembly 20 can be installed in shower wall 22 at a height suitable to accommodate the height of various users.

Advantageously, vertical and horizontal axes 71 and 73 are independent of each other. Accordingly, adjustments can be made in either direction regardless of the orientation of spray face 24 with respect to the other direction. Bodyspray assembly 20 thus enables omni-directional adjustment of the orientation of spray face 24 and corresponding directed spray. Furthermore, fine manual adjustments to the angular orientation of spray 30 can be easily made by the user while showering.

Moreover, bodyspray assembly 20 enables flat spray face 24, which is flush-mounted in wall 22, that receives water from a waterway, provided by U-Shaped waterway member 46, waterway housing 68 and elbow waterway bodies 84, that is more compact than previously achieved, thereby capitalizing on limited space available in conventional stud pockets of domestic walls. The position of coupling assembly 66 (which determines the angular orientation of spray 30) is also more easily continuously adjustable within its range than conventionally achieved with flush-mounted spray faces.

Figure 10:
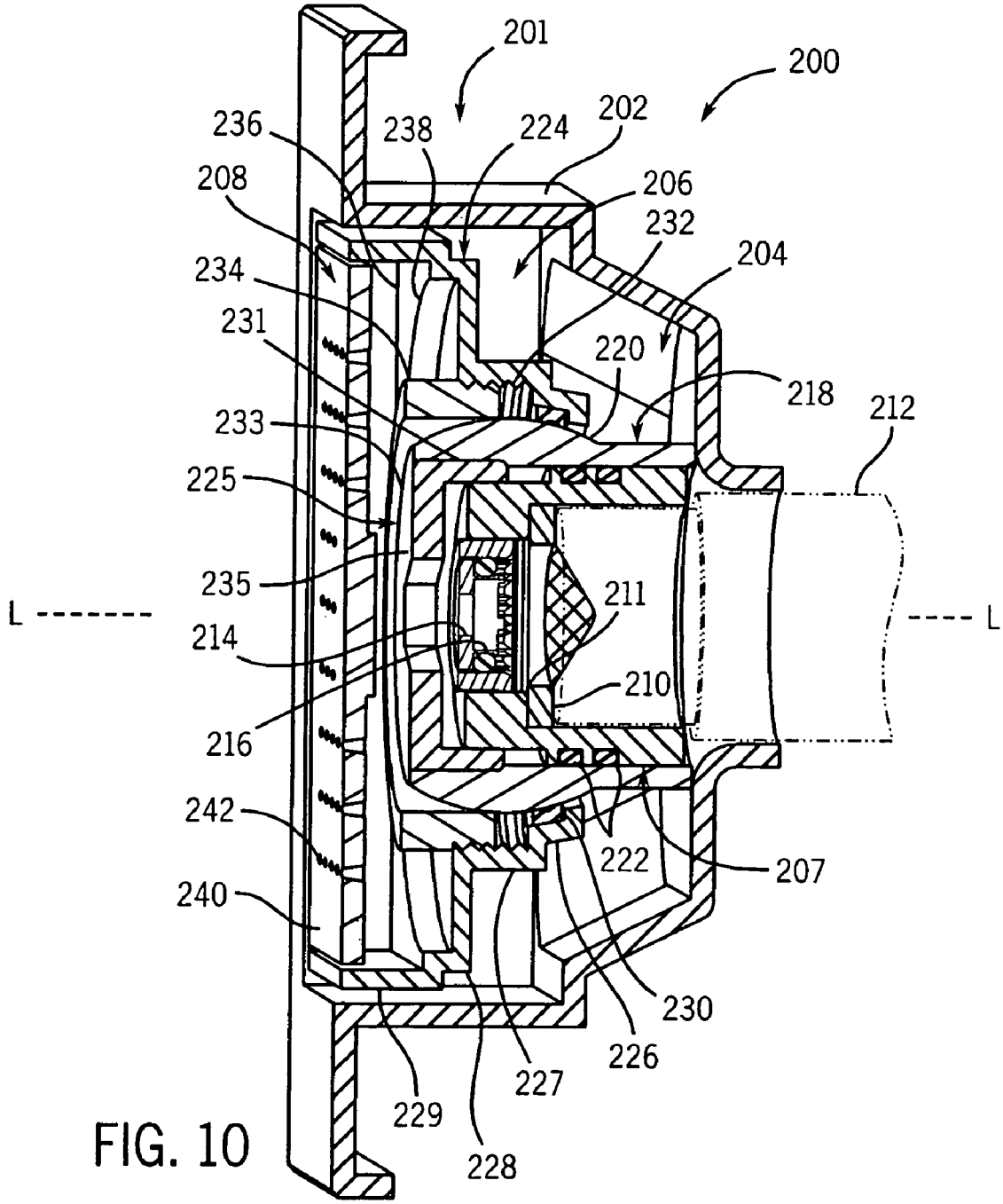
FIG. 10 is a sectional side elevation view of a bodyspray assembly constructed in accordance with an alternative embodiment of the present invention to provide universal pivoting of the spray face.

Referring now to FIG. 10, a bodyspray assembly 200, constructed in accordance with an alternative embodiment, includes a casing 201, in the form of an escutcheon 202, that retains a water inlet assembly 204, an omni-directional coupling assembly 206, and a spray outlet assembly 208, each assembly extending along a central longitudinal axis L-L.

Water inlet assembly 204 includes an NPT pipe fitting 207 that contains a filter screen 210 and a flow regulator 211. Pipe fitting 207 receives water from a water supply pipe 212, and operates as described above with respect to bodyspray assembly 20. An annular fitting 214 is sealed against flow regulator 211 via an o-ring 216, and outputs the metered supply water from water inlet assembly 204.

Omni-directional coupling assembly 206 includes a substantially cylindrical central hub 218 having an outer frustospherical surface 220 located at the longitudinally forward end of hub 218. A pair of o-rings 222 seals hub 218 against pipe fitting 206.

A waterway member 225 includes an annular arm 231 disposed between pipe fitting 207 and the forward end of hub 218, and a radial outer wall 233 is substantially radially aligned with the terminal end of hub 218. A centrally disposed aperture 235 extends through outer wall 233, and receives the supply water from annular fitting 214.

A spray face support wall 224 includes four substantially longitudinally extending steps 226-229, each step progressively forward and radially outward from the previous step. A bearing member 230 is disposed between step 226 and frustospherical surface 220, thus enabling support wall 224 to ride along surface 220. A seal 232 is threadedly inserted into the second step 227 of wall 224, and is thus disposed between surface 220 and second step 227. A cylindrical wall 234 is also threaded into second step 227, and terminates at seal 232, such that the forward end of wall 234 is radially aligned with the forward end of hub 218. A plate 236 extends inwardly from third step 228, and defines a cylindrical opening 238 that accommodates cylindrical wall 234.

The fourth step 239 extends longitudinally adjacent escutcheon, and supports a flat and rectangular (or square) spray face 240 substantially flush, or co-planar, (or slightly recessed) with respect to escutcheon 202. Spray face 240 defines an array of outlet openings 242 receiving the supply water from aperture 235, and emitting the supply water as a directed spray 244 (FIG. 11).

Figure 11:
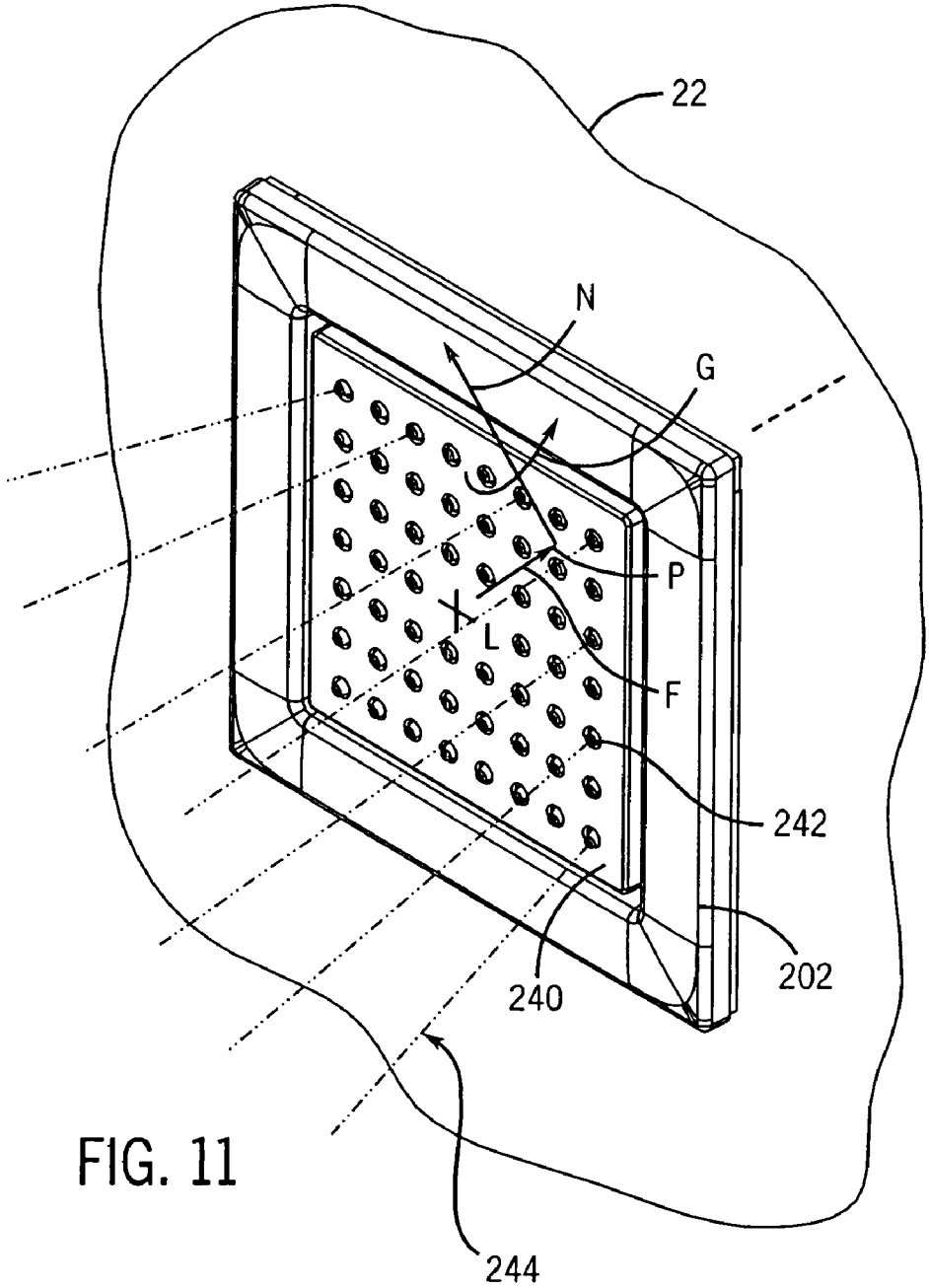
FIG. 11 is a perspective view of the adjustable spray face illustrated in FIG. 10, showing the spray face pivoting as determined by a location of a spray face depressive force.

Referring to FIG. 11, during operation, the angular orientation of spray face 240 (and the corresponding directed spray 244) is easily manually adjustable by a user. Specifically, the user applies a longitudinal depressive force to the outer surface of spray face 240 at a position "P" defined along an axis (arrow F) from central longitudinal axis "L". The applied depressive force causes support wall 224 (along with bearing member 230, seal 232, and cylindrical wall 234, to ride and swivel along frustospherical surface 220 (which provides a track for support wall 224). The angular orientation of spray face 240 is thus biased about an axis "N" (normal to arrow F) in the direction of arrow G.

Notably, the diagram of FIG. 11 also applies to bodyspray assembly 20 because the angular orientation of spray face 24 is omni-directionally adjustable as described above. Furthermore, the present invention recognizes that frustospherical surface 220, while providing for omni-directional angular adjustment of spray face 240, also provides for angular adjustment of spray face 240 about a vertical and horizontal axis, as described above with respect to bodyspray assembly 20.

It should be appreciated that merely preferred embodiments of the invention have been described above. However, many modifications and variations to the preferred embodiments will be apparent to those skilled in the art, which will be within the spirit and scope of the invention. Therefore, the invention should not be limited to the described embodiments. To ascertain the full scope of the invention, the following claims should be referenced.

The invention claimed is:

1. A bodyspray assembly extending along a central longitudinal axis and configured to be mountable on a shower wall and receive supply water from a source and emit the supply water as a directed spray, the bodyspray assembly comprising:

a coupling assembly including a housing configured for rotation about at least a first and second axis;

a spray outlet assembly including a flat spray face in the form of a tile, the spray face defining an array of apertures; and an escutcheon framing the spray face, wherein the escutcheon surrounds the spray face;

the spray outlet assembly being connected to the housing such that a longitudinal depressive force applied to the spray face at a position offset from the central longitudinal axis causes the apertures to pivot about an axis normal to an axis defined between the central longitudinal axis and the position, and if the spray face is in a first position where the spray face is substantially flush with respect to the escutcheon will cause the spray face to move from the first position to a second position where the spray face has swiveled within the escutcheon.

2. The bodyspray assembly as recited in claim 1, wherein the coupling assembly is a bi-directional coupling assembly comprising a body that rotatably supports the housing.

3. The bodyspray assembly as recited in claim 1, wherein the coupling assembly is an omni-directional coupling assembly comprising a hub providing an outer spherical track, wherein the housing rides along the track.

4. The bodyspray assembly as recited in claim 1, wherein the supply water flows through the coupling assembly.

* * * * *